US005738590A

United States Patent [19]

Lochtefeld

[11] Patent Number: 5,738,590

[45] Date of Patent: Apr. 14, 1998

[54] METHOD AND APPARATUS FOR A SHEET FLOW WATER RIDE IN A SINGLE CONTAINER

[76] Inventor: Thomas J. Lochtefeld, 5508 Pacifica Dr., La Jolla, Calif. 92037-7251

[21] Appl. No.: 715,136

[22] Filed: Sep. 18, 1996

Related U.S. Application Data

[63] Continuation of Ser. No. 295,701, filed as PCT/US93/01980, Mar. 4, 1993, published as WO93/17762, Sep. 16, 1993, abandoned, which is a continuation-in-part of Ser. No. 846,204, Mar. 4, 1992, Pat. No. 5,271,692, which is a continuation-in-part of Ser. No. 722,890, Jun. 28, 1991, Pat. No. 5,229,465, which is a continuation-in-part of Ser. No. 577,741, Sep. 4, 1990, Pat. No. 5,236,280, which is a continuation-in-part of Ser. No. 286,964, Dec. 19, 1988, Pat. No. 4,954,014, which is a continuation-in-part of Ser. No. 54,521, May 27, 1987, Pat. No. 4,792,260.

[51] Int. Cl.[6] ..... A63G 21/18

[52] U.S. Cl. ..... 472/117; 472/88

[58] Field of Search ..... 472/116, 117, 472/88, 89, 90, 128, 129; 403/79

[56] References Cited

U.S. PATENT DOCUMENTS 586,718 7/1897 Wharton ..... 472/128

4,339,122 7/1982 Croul ..... 472/117

*Primary Examiner*—Kien T. Nguyen

*Attorney, Agent, or Firm*—Knobbe, Martens, Olson & Bear, LLP

[57] ABSTRACT

Sheet wave generators have recently been hailed as the new generation of simulated wave generating water rides. The present invention relates to a sheet wave generator with a riding surface appended to a single container of water, i.e., a swimming pool, wave pool, or any existing or new water facility. Because the riding surface of the present invention is contained along its outer periphery, the water ride can be compact so that is suitable for placement in a relatively small area of land. The ride surface itself has an inclined surface, a transition turn area, and a downward declining surface which feeds back into the pool. This butterfly configuration is relatively compact, and can be situated such that the flow of water comes from and returns to the pool area. In one embodiment, the invention also has a unique nozzle outlet area which is at or slightly below the elevation of the water surface in the pool, so that riders may skim over the nozzle area and onto the riding surface directly from the pool area. In another embodiment, the invention shows the nozzle outlet area to be elevated in a safe and compact manner thus enabling adaptation to differing site conditions.

22 Claims, 11 Drawing Sheets

METHOD AND APPARATUS FOR A SHEET FLOW WATER RIDE IN A SINGLE CONTAINER

This application is a continuation of U.S. patent application Ser. No. 08/295,701, filed Nov. 28, 1994, now abandoned, which is a 371 application of PCT/US93/01980 filed Mar. 4, 1993, which is a continuation-in-part of U.S. patent application Ser. No. 07/846,204 filed Mar. 4, 1992 now U.S. Pat. No. 5,271,692, which is a continuation-in-part of 07/722,890 filed Jun. 28, 1991 now U.S. Pat. No. 5,229,465, which a continuation-in-part of U.S. patent application Ser. No. 07/577,741 filed Sep. 4, 1990 now U.S. Pat. No. 5,236,280, which is a continuation-in-part of U.S. patent application Ser. No. 07/286,964 filed Dec. 19, 1988 now U.S. Pat. No. 4,954,014, which is a continuation-in-part of U.S. patent application Ser. No. 07/054,521 filed May 27, 1987 now U.S. Pat. No. 4,792,260.

FIELD OF THE INVENTION

The present invention relates in general to a sheet flow water ride in a single pool comprising an appended inclined container rising above said pool, wherein various effects can be created by injecting a power flow of water onto the appended inclined container, whereby the flow of water circles around on the plane of the incline, and returns back to said pool.

BACKGROUND OF THE INVENTION

Sheet flow water rides have recently been hailed as the new generation of simulated wave generating water rides. Initially, the sheet flow generator was designed to simulate existing natural waves and phenomenons, such as a tunnel wave, which is highly prized by surfers.

Generally, sheet wave generators inject water onto an inclined surface upon which surfing maneuvers could be performed. The inclined surface is containerless so that the supercritical flow of water will not be slowed down along the side of the incline. The water flowing from the inclined surface is collected in supplementary pools or moats and then recirculated back through a channel to an elevated container from which the water is extruded back onto the incline.

One disadvantage of previous sheet wave generator systems is that they required a substantially large area of land which can be scarce and costly to provide. Moreover, previous sheet wave generators often required separate pools and elevated containers for storing water for use in operating the sheet wave generating device. Elevated containers are not only costly to build, but in the case of a contained inclined surface, water is predisposed to undesirably flood the lower inclined container during the start-up and shut-down phases. Furthermore, the design of the previous prior art inclined containers were disadvantageously inflexible in their ability to self-clear water during operation (e.g., in the event of rider induced decay). Also, due to the need for water to flow over the upper edge of the incline, variable size wave shapes for differing levels of rider expertise could not be provided. There is, therefore, a need for a more compact sheet wave generating water ride design which overcomes the disadvantages of prior inclined containers, and yet, provides the thrill of simulated water skimming activities.

SUMMARY OF THE INVENTION

The present invention represents a substantial improvement to prior sheet wave generating systems in that the present invention comprises a compact water ride configuration and design that is self-contained within or adjacent a single pool area. The water ride of the present invention has an appended inclined container which allows simultaneous upward and downward movement of water flow and permits surfing and skimming maneuvers in a relatively compact ride area. Due to its compact size, an existing swimming pool, diving pool, or wave pool can be retrofitted to incorporate the ride surface of the present invention. Thus, the advantage of this invention is that it may be installed in existing facilities, and/or in a relatively small space, which in view of the high cost of land, reduces the cost of installation. Also, unlike the previous sheet wave generating devices, the present invention does not need an elevated container, which is bulky and costly, as a water storage/pressure source for generating sheet flow. Rather, the pool into which the riders land serves as the water source to supply water to the water ride.

The unique positioning of the subject invention's nozzle/injection mechanism, i.e., water jet, also provides a completely new concept in sheet flow rider entry. In this regard, water is pumped from beneath the pool and extruded from a nozzle area which is at or below the elevation of the water in the pool. Because the nozzle injection is at or below the surface of the water in the pool, the rider may skim over the top of the nozzle area and can then be propelled by the injected water up the incline again. This unique feature significantly increases user capacity and throughput.

In another embodiment, the subject invention's nozzle/injection mechanism is positioned at an elevation above the main riding surface, so that the water being injected travels first downward on a declined surface and then upward onto the incline surface. This decline surface helps prevent the rider, who performs water-skimming maneuvers on the incline surface, from sliding accidentally into the nozzle/injection mechanism. The decline surface at the nozzle/injection entry area also permits the riding surface to be more compact.

The present invention also represents a substantially improved sheet wave generator water ride, comprising in one embodiment a butterfly shaped return configuration which is appended to or adjacent a single container, i.e., a pool. The preferred embodiment of the present invention advantageously directs a supercritical flow of water upward onto an incline, whereby the water reaches the apex and returns back down substantially the same plane of incline to the pool area. The present invention advantageously allows the rider to perform maneuvers on the upward and downward slopes as well as to ride the apex of the turn.

One advantage of the present invention is that a rider, carrying an inner tube or boogie board, etc., may enter the ride from the top of the incline or may also enter the riding surface from the pool area. This double entry system advantageously increases user capacity, and in turn, user throughput, as well as extends user enjoyment time.

In the present invention, water is injected onto the riding surface, and flows upward on a predominantly gradual incline at a supercritical velocity. The unique configuration of the butterfly return is designed so that the body of water reaches an apex at the top of the turn, and, by virtue of the configuration of the turn, various hydraulic effects are created. After the water flow transitions around the turn, it returns to the pool area due to gravity down the plane of the inclined surface.

Because the water ride consists of a single inclined container in the shape of a butterfly return, water can be maintained on the inclined ride area and directed back to the pool area, with no need for an overflow to adjacent containers. Unlike the prior art that utilizes various containers and pools at different elevations, the present invention comprises a single contained ride surface and return.

Due to the unique butterfly configuration of the ride surface, the flow of water flows up the incline, and due to the container sidewalls along the top edge of the 180° turn, the flow of water in conjunction with the downward force of gravity is directed back toward the pool area from which the water was injected. The inclined surface is also tilted slightly on each side of the incline, such that the surface nearest the inside of the turn is lower in elevation than on the outside of the turn. This gradual tilt extends into the curved butterfly return portion, such that the inclined surface eventually forms an embankment.

In addition, due to the slight tilt on the inclined portion of the riding surface, water will tend to flow off the side of the incline and into a shallow swale located adjacent the incline. The swale is a transition area on the inside of the turn between the upward and downward flows, and helps keep the upward and downward flows separate. A rider riding on the inclined surface may safely slide into the swale and be allowed to return to the pool area without being carried around the embanked turn. On the other hand, by maneuvering the rider's riding vehicle, the rider may be propelled around the embankment for a thrilling ride experience.

In one embodiment of the present invention, the embankment is configured such that various hydraulic jumps are created along the turn. In this embodiment, the water flows at a supercritical velocity from the outlet nozzle onto the incline surface, and is propelled against the outer wall along the edge of the turn. At this juncture, a hydraulic jump is created and the water is directed back down the plane of the incline toward the pool area.

In this embodiment of the present invention, the flow of water can be adjusted to accommodate varying abilities and skills of the riders. To accommodate the novice rider, the supercritical velocity of flow can be reduced such that the water is not propelled to the highest elevation point of the embanked turn. A reduced velocity of upwardly injected flow will result in a hydraulic jump with an associated subcritical flow at some midpoint on the incline. Once the water velocity becomes subcritical, the water seeks the low pressure area on the side of the incline, where the water flows around the transition area and down into the pool.

For the intermediate rider, the supercritical velocity of the flow can be increased so that the water flows up around the embanked turn, where various water effects are created at the apex of the turn. An experienced rider may maneuver on the turn and "ride the apex," before descending from the embanked turn into the pool area.

It should also be worth noting that, in another embodiment, the embankment can be configured and designed so that the flow of water around the turn can maintain a virtually supercritical velocity. To create a virtually supercritical flow around the embankment, the surface must be configured with two independent principles in mind, namely, the FROUDE number and MASS CONSERVATION.

Other than the hydraulic jumps, boils and eddies created on the embankment, the main hydraulic jump in this embodiment of the invention is at the merging point of the supercritical flow and the pool area. As the rider comes off of the embanked turn, and down the plane of the incline, the rider splashes into the pool area at the point of the main hydraulic jump.

It should be worth noting that two identical reverse positioned embanked turns can be placed side by side to create the butterfly return. Two different embanked turns with different slopes and curvature can also be placed side by side, thus creating two distinct water rides. However, the present invention may also comprise only one embanked turn in one direction, rather than having two positioned in opposite directions.

Once the rider completes the embanked turn and lands in the pool area, the rider may remain in the pool, or exit the pool and re-enter by way of the entry slide, or in one embodiment, paddle towards and over the nozzle outlet area to be propelled around the embanked turn again. The advantage of the present invention is that the entire ride surface is located in or adjacent a pool comprising a single elevation. Because the pool is at a single elevation below the elevation of the contained riding surface, there is no tendency for water to flood the inclined surface. Thus, there is no need to pump water from the riding surface as required in some previous rides.

With respect to the water injection mechanism, the present invention consists of a water pump advantageously located beneath the appended inclined riding surface. The advantage of having the pump beneath the inclined surface is that the pool area adjacent the nozzle outlet is relatively clear and free of any interferences otherwise caused by an elevated container or other injection mechanism adjacent the nozzle area. Nevertheless, the pump can be located elsewhere as mandated by site specific conditions.

In the preferred embodiment, water is generally pumped from a location below the inclined riding surface and upward toward a nozzle outlet, wherein the water is forced upward and over backwards, turning the water upwardly 180°. The water is extruded through a narrowing nozzle area, forcing water through the nozzle outlet, which is substantially smaller in cross-sectional area than the channel beneath. The water enters the nozzle area thick, makes a sharp 180° turn upward, and is then extruded to the proper flow thickness, i.e., approximately 2 inches, onto the riding surface. The flow thickness can be altered by adjusting the nozzle height from between ½" to 10" depending on the flow dynamics desired.

In an alternate embodiment, the pump can be located adjacent the riding surface at a position which permits pumping of the water from the pool onto the incline surface. Because in the alternate embodiment, the water travels initially downward, the pump is positioned so that it retrieves water from the lower elevation pool area and pumps water upward into the nozzle/injection area, wherein the water is propelled downward to create the flow dynamics required.

The entry slide upon which a rider enters the water ride is located substantially in the center and at the top of the inclined surface area. The entry slide allows the rider to enter onto the inclined surface against the flow of water, wherein the rider may perform skimming and surfing maneuvers thereon. The entry slide has a convex shape which diverts water away from the slide to either side so that the water does not flow onto the entry slide area. The entry slide is also slightly higher in elevation than the riding surface, and can be positioned with a steeper inclination, so as to avoid the problem of having water flowing up the slide. The slide can also have a flow fence on either side, which prevents riders from falling off the slide area, but which also allows excess water to flow off the slide and back onto the inclined surface.

In the alternate embodiment, a similar entry slide can be positioned so that a rider can enter the water ride along the side of the incline surface, wherein the rider enters the incline surface against the flow of water. An alternate slide entry can also be provided adjacent the nozzle/injection area which permits a rider to enter the ride surface in the same direction of flow as the flow of water on the surface.

The surface profile of the appended inclined container is designed to accommodate varied flow areas: (1) the power flow area, where flow is supercritical up the incline, (2) the transition return area, where the water turns direction, and (3) the downward flow area where the water returns back to the pool. The transition area also comprises a swale extending down from the bottom of the embankment between the upward and downward flows, which allows run-off water to be drained so that the upward flow is not affected by the downward flow and vice versa. The butterfly return shape is also contained along the periphery so that the water remains on the turn. The outside curve of the return is flared upward, or may have sidewalls to retain the water, as well as the rider, on the curved surface.

Ideally, the curvature is designed such that the water on the outside curve moves at a velocity sufficient to carry the water around the turn. The water on the inside of the turn, in the transition area, may move substantially slower and provides a mixing area of upward and downward flows.

Due to the design and curvature of the turn, the water flow will be substantially supercritical up to the apex of the turn, after which, various flow effects caused by the resultant changes in velocity and surface shapes are generated. Moreover, due to the changes in direction of flow along the turn, various boils, eddies and special water effects may be created.

Once the water flows around the turn, the water comes down the plane of the incline and back into the pool area, whereby a major hydraulic jump is created in the splash area caused by the merger of the downward moving flow of water and the standing pool water. In one embodiment, the plane of incline with downward returning flow is generally less steep than the incline with upward flow, and gradually returns to the horizontal before reaching the pool area. Once the rider enters the pool, the rider may either exit the ride or remain in the pool, or may paddle towards the center of the pool, whereby the rider may skim over the nozzle area and onto the inclined surface again in the preferred embodiment. This feature advantageously increases user capacity and throughput and extends user enjoyment time, as riders may continue to ride the inclined butterfly return riding surface repeatedly. Obviously, operational procedures would prohibit collisions between nozzle entry riders and top of incline entry riders.

One major advantage of this invention is that the entire water ride is self-contained within one pool area, wherein the pool serves as the container from which the water is extruded onto the riding surface. Moreover, because the water ride is itself contained within one pool area, the exit and entry areas are close in proximity. This advantageously allows efficient transfer of ride vehicles from the exit area to the entry area. Also, this advantageously reduces the number of life guards that must be stationed around the pool to watch for possible drowning and other accidents.

In another embodiment of the present invention, It tunnel wave generating device is obliquely positioned at the top of the inclined surface area on the outer edge of the butterfly return configuration. The tunnel wave generating device is obliquely positioned such that the water flows up and across the surface of the wave generating device and is directed back onto the downward flow of the incline plane. In this embodiment, the supercritical velocity is slightly greater, such that the flow of water maintains a supercritical flow up and across the tunnel wave generating device. This embodiment forms a dramatic tunnel wave at the top of the incline, upon which advanced riders may maneuver. Due to the increased velocity, the entry slide of this embodiment may be slightly elevated and inclined above the riding surface to prevent water from flowing up and onto the entry area.

In another embodiment of the present invention, the entire inclined surface may be substantially planar such that the water coming from the injected nozzle flows onto the inclined surface and, by virtue of drag and gravity forces, becomes subcritical tit the top and turns back in a butterfly-shaped fashion. In this embodiment, the water is allowed to reach a subcritical flow at the top and in the transition areas along the sides of the incline. Also, due to the natural tendency for water to move from a high pressure area to a lower pressure area, the water flows down either side of the inclined surface and back into the pool area.

In another embodiment, an effect can be created on just one side of the incline, where the entire flow moves up the incline and, due to gravity, flows off to one side and back around into the pool. The inclined surface in this embodiment is tilted only to one side such that, by the time the water reaches the top of the incline, the water begins to turn in the direction of the tilt, and then downward back towards the pool. The nozzle can also direct the flow of water at an angle in a direction toward the downward tilt. In this embodiment, the water can remain substantially supercritical along the entire arcing flow plane.

DETAILED DESCRIPTION OF THE INVENTION

The present invention is described as a sheet wave generator water ride in a single container, i.e., the entire water ride is situated within or immediately adjacent to a single pool area, or an existing wave pool, etc., and the appended inclined surface is self contained around its periphery. Due to the compact design of this water ride, it may be located within a single pool area, which reduces the amount of land needed, as well as the cost of installing the ride. Thus, the present invention can be retrofitted into an already existing swimming pool, or any other body of water such as a wave pool already built into a water park. Also, bystanders can view the entire ride which is important for safety reasons, as well as for encouraging viewer interest in the ride. The advantage of the present invention is that it may be placed in a small area of land, making it ideal for placement into existing water parks where land may be scarce or limited.

Figure 1:
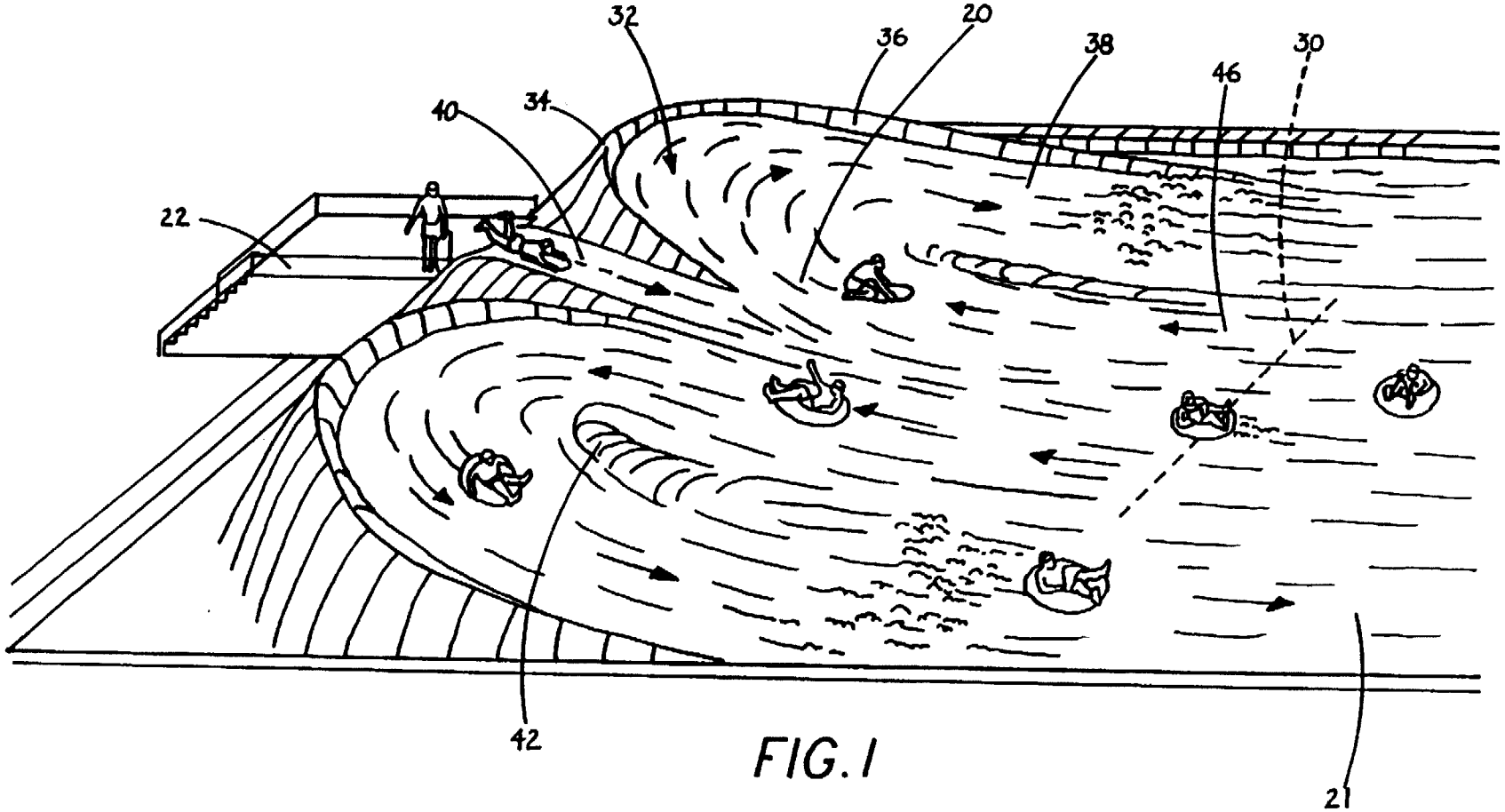
FIG. 1 is an illustration of the present invention showing the configuration of the butterfly return embodiment.

FIG. 1 shows a preferred embodiment of the present invention, wherein an inclined riding surface 20 having a butterfly configuration is located in a single pool area 21, with the incline surface on one end thereof. In this embodiment, the pool 21 is preferably approximately 60 feet in width and the length is approximately 100 feet.

The incline riding surface 20 can be constructed onto and above an existing swimming pool or the like, out of fiberglass, stainless steel or concrete, with a soft foam covering on the riding surface sealed with a urethane polymer paint. The soft foam is furnished to provide cushioning support for safety, and the urethane polymer paint is applied to provide a slick surface which reduces the amount of frictional drag on the riding surface 20. Alternatively, the riding surface 20 may also be constructed adjacent an existing or new pool, as can best be seen in FIG. 1*b*, wherein the incline surface can be formed of concrete or fiberglass with a similar soft foam and urethane polymer paint. In this particular embodiment, various underground channels are required for the circulation pump and sump underneath the riding surface.

At one end of the pool adjacent the top of the incline surface 20, an elevated entry ramp 22 is provided. The entry ramp is a queuing area for riders waiting to enter the water ride. The entry ramp area 22 can be constructed of any material, and can be of any size. In fact, the entry ramp area 22 can be built into the ground on the side of a sloped hill adjacent the pool, in which case the incline surface area 20 can also be constructed on the same slope.

Preferably, the pool 21, in the area of use, shall be approximately three to four feet in depth, and no more than five or six feet, so as to reduce the risk of drowning. At the junction between the riding surface 20 and the pool area 21, a barrier (not shown) may be placed to prevent objects and swimmers from flowing underneath the riding surface 20. This barrier is not necessary if the incline surface 20 is built into the ground adjacent the edge of the pool area as can been seen in FIG. 1*b*.

Figure 2:
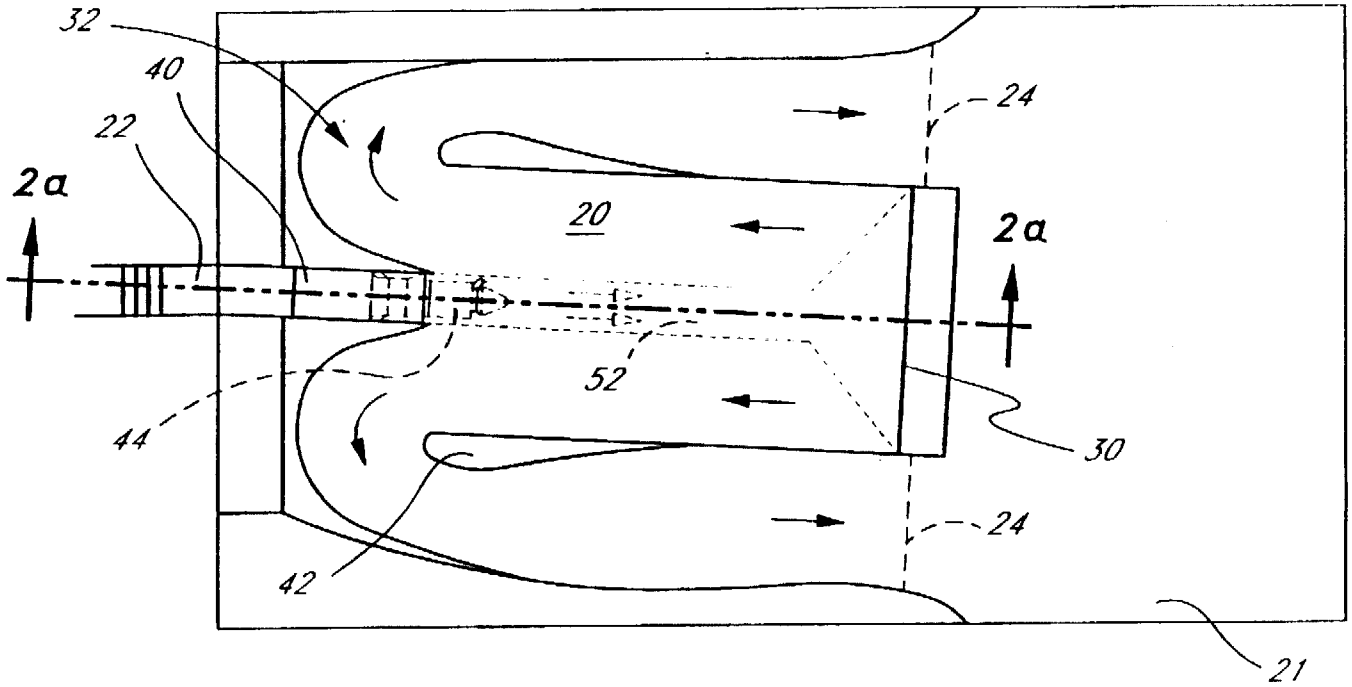
FIG. 2 is a plan view of the present invention showing the configuration of the butterfly return embodiment.
Figure 2A:
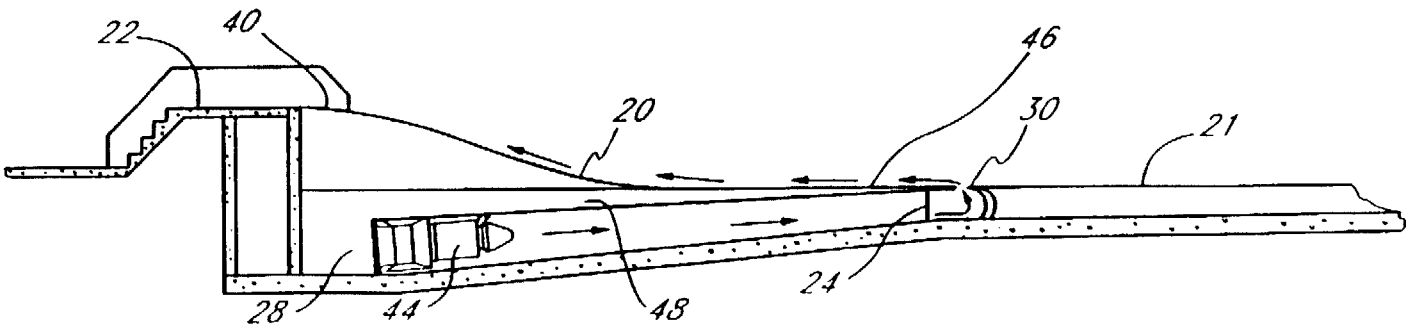
FIG. 2*a* is a cross-sectional view of the present invention taken along line 2—2 of FIG. 2.

In FIG. 2*a*, a grate 24, also serving as a barrier, is provided which allows the passage of water, whereby water is drawn through the grate from the pool 21 into a sump area 28. The water is then pumped through the pump up to an outlet nozzle 30, i.e., jet, which is substantially centered in the pool area. The relative placement of the outlet nozzle area 30 can best be seen in FIG. 2.

FIGS. 1 and 2*a* shows the preferred embodiment of the present invention, with a nozzle area 30 positioned at a level substantially equal to or lower than the elevation of the water surface in the pool area 21. A supercritical flow of water is injected onto the ride surface through nozzles 30 pointed in the direction of flow, but the nozzles are slightly submerged within the pool 21 so that the nozzle does not obstruct riders flowing over the nozzle area. Because only a relatively small amount of water can flow over the top of the nozzle area 30, the significantly higher momentum of the supercritical water flow is only slightly affected by the water flowing over the nozzle area. The advantage of having the nozzle area 30 at or below the surface of the pool 21 is that riders may ride over the nozzle area and be propelled up the inclined surface 20 directly from the pool area, which advantageously increases user capacity and throughput.

FIG. 1 also shows the flow of water being injected onto the ride surface 20 in the direction of flow, whereupon riders may perform skimming maneuvers thereon. Each inclined ride surface 20 is at least 10 feet in width on each side of the butterfly return 32, and preferably at least 15 feet in width to permit various skimming maneuvers to be performed on the incline. The total width, therefore, is preferably about 60 feet. The inclined surface 20 extends upward and around an embankment 34, which turns the flow of water around a 180° turn. This butterfly return 32 configuration is designed such that the flow of water has various hydraulic jumps, boils and eddies at the apex of the turn. Various deformations and topographical changes may also be formed on the turn to create additional effects.

As can be seen in FIG. 1, at the top of the incline surface 20 is an embankment 34 which transitions into outside edge or sidewall 36, which maintains the flow of water on the ride surface. The sidewall 36 can extend all the way around the outer edge of the butterfly return 32 configuration to maintain the water on the ride and also to maintain the rider on the ride surface 20. The curvature of the sidewall 36 can also be varied along the outside perimeter of the turn, to cause various flow effects as the water flowing up the incline moves up and across the sidewalls.

Figure 1A:
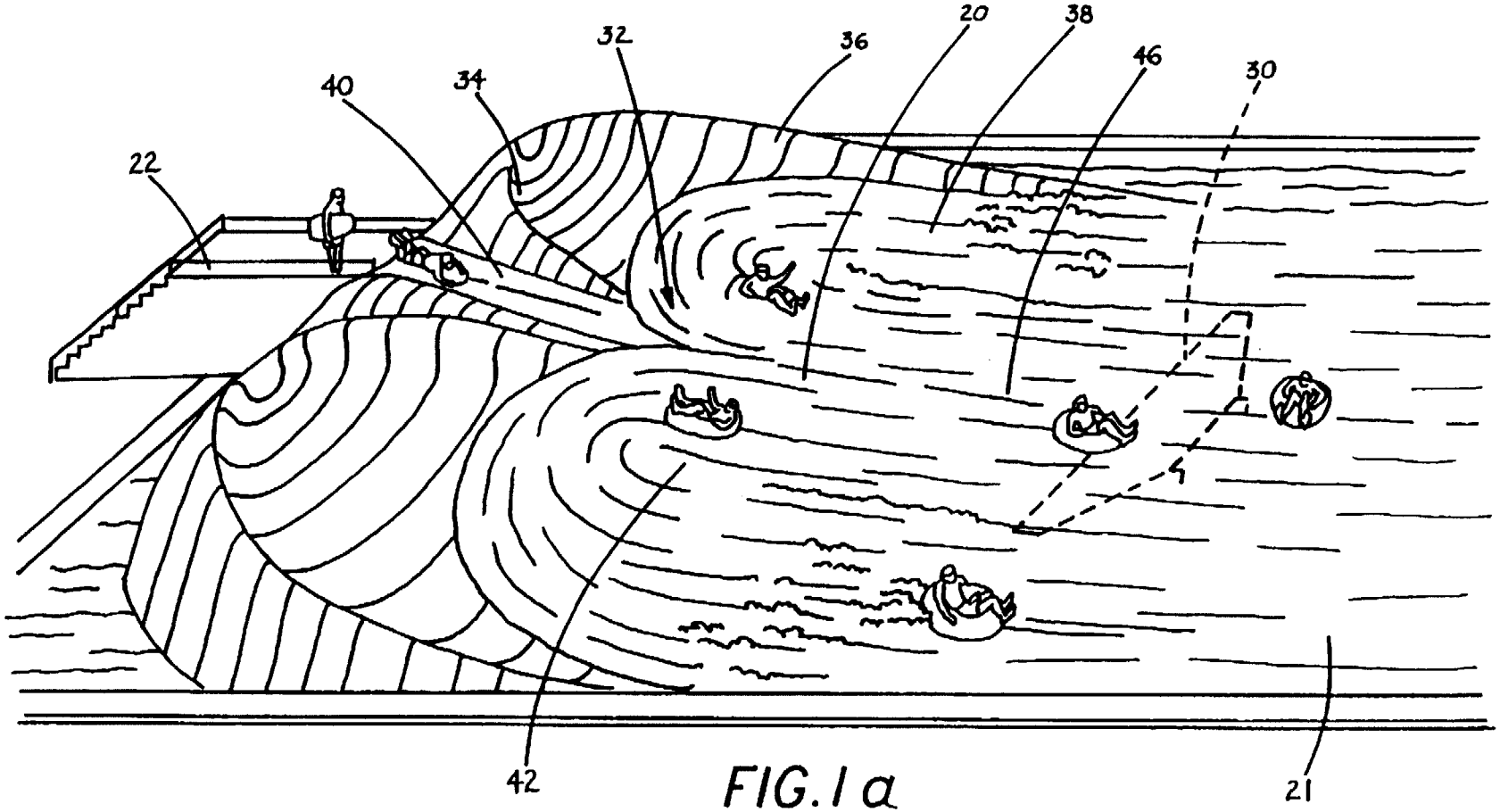
FIG. 1*a* is an illustration of the present invention showing a reduced flow on the incline for novice riders.

The velocity of the supercritical flow can also be adjusted to accommodate varying abilities and skills. FIG. 1*a* shows the pattern of flow at low velocities for novice riders. The water reaches a subcritical flow below the apex of the turn 34 and flows across and down the declined surface due to the slight tilt in the incline.

Figure 1B:
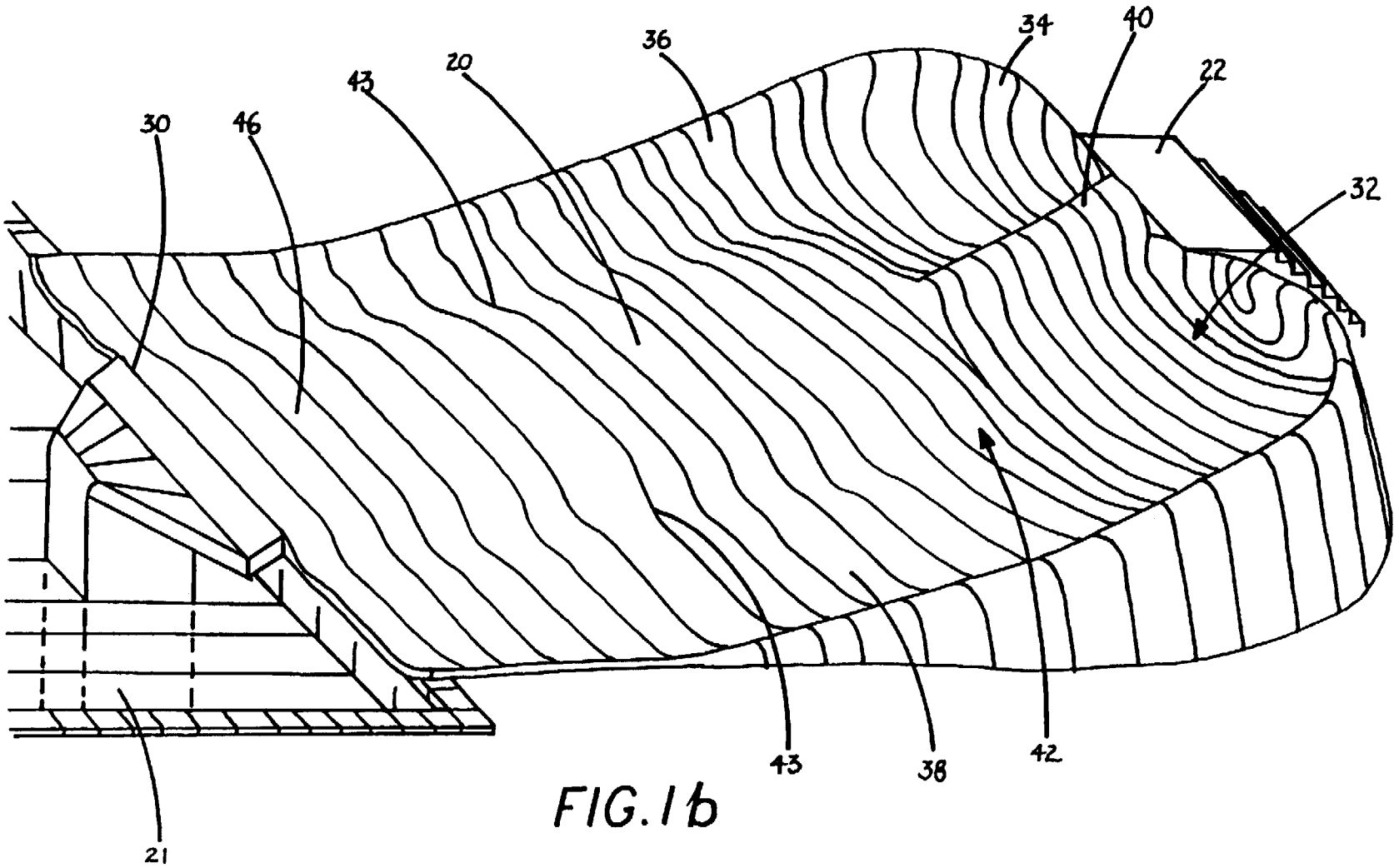
FIG. 1*b* is an illustration showing the contour of the inclined container.

FIG. 1*b* shows the general contour of the inclined container with the butterfly return 32. As can be seen, a swale 43 is located between the upward and downward flows in the transition area. The inclined container also has sidewalls 36 or curved edges to contain the water as well as the rider on the riding surface. FIG. 1*b* also shows how the inclined container can be positioned adjacent an existing pool.

In one embodiment, the butterfly configuration can be designed so that supercritical flow is achieved around the majority of the turn, provided that the width and cross-sectional area along the width is calculated with two principles in mind, namely, MASS CONSERVATION and the FROUDE number. To maintain a supercritical flow at any point around the turn, the FROUDE number must be greater than one, which is a function of flow speed and flow depth.

The flow of water comes down from the embankment 34 on the declining portion 38 of the water ride primarily due to gravity and splashes into the pool area 21 creating the main hydraulic jump. The rider coming off the embankment 34 can ride down the decline 38, which is much like riding a white water rapid, and can splash into the pool.

FIG. 1 also shows an entry slide 40 located at the top of the incline 20 at the center of the butterfly return 32 configuration. The entry slide 40 is convex in cross-sectional shape so as to divert water flowing upward on the inclined surface 20 away from the slide. The slide 40 can also be slightly higher in elevation than the incline surface 20 and can have a slightly greater inclination. The slide area 40 can also have a flow fence (not shown) which helps maintain the rider on the slide while allowing water to flow off the side of the slide. The water from the slide 40 can either be diverted back onto the inclined surface 20, or may fall through into the container below in one embodiment.

FIG. 2 shows a plan view of the butterfly return 32 configuration. As can best be seen in FIG. 2, the outlet nozzle 30 is preferably located substantially in the center of the pool area 21 and directs water in a unidirectional flow up the inclined surface 20 and around the butterfly return 32 configuration. FIG. 2 shows the incline riding surface 20 situated within a relatively large rectangular shaped pool 21, with the entry slide 40 at the end closest to an entry stair/ramp 22. This plan view also shows the relative length and width of the inclined surface in both the upward and downward directions, as well as the transition area 42 on the inside of the turn between the respective upward and downward portions.

FIG. 2*a* is a cross-sectional view of the present invention situated inside an existing swimming pool 21, with a circulation pump 44 situated at the deep end of the pool. The cross-sectional view shows how the incline surface 20 can be positioned within an existing swimming pool, with the entry stair ramp 22 and slide 4(1 at one end of the pool. The incline surface can be made of any strong corrosion-free material such as stainless steel, fiberglass or concrete with a soft foam covering.

FIG. 2*a* also shows an extended horizontal riding surface 46 which, preferably extends at least 15 feet in length. FIG. 2*a* also shows the incline surface 20, which extends from the horizontal portion 46 in the direction of water flow. The highest point along the incline surface 20, which is at the apex of the butterfly return 32 configuration, is generally about 4½ feet above the elevation of the horizontal surface 46, although the elevation can vary depending on the flow dynamics desired. The horizontal surface 46 adjacent the nozzle outlet 30 can vary in length depending on desired operational objectives and size constraints, but preferably, the ratio of the elevational change to the horizontal length is approximately one to three. This is because the length of the horizontal surface area 46 should be long enough to cause the rider riding down the incline surface 20 due to gravity, to be propelled back up the incline by the force of the supercritical flow. If the horizontal surface area 46 were relatively short in length, the rider would come down the incline 20, and conceivably, overrun the nozzle area 30. The horizontal surface area 46 must be sufficient in length to allow the flow to provide enough momentum transfer to push the rider back up the incline 20 before he reaches the nozzle outlet area 30.

FIG. 2*a* also shows the circulation pump 44 and sump area 28 located beneath the inclined surface area 20. The positioning of the circulation pump 44 beneath the inclined surface 20 advantageously frees the remainder of the pool area 21 from any interference from the mechanical devices needed to drive the water ride. The water pump 44 can be positioned in the pool beneath the riding surface, or, housed within a vault structure located adjacent the pool in the other embodiment. In the retrofitted version, a grate 24 can be positioned in the pool to separate the pool area from the sump area beneath the riding surface. The grate 24 can extend downward from the riding surface and can be connected to the bottom of the pool. The grate 24 prevents objects or swimmers from being caught in the sump area, and simultaneously allows water to freely flow between the pool area and sump area.

The pump 44 draws water from the sump area 28 adjacent the pool and directs water slightly upward through an underwater channel 52. The water under pressure is forced toward an upwardly curved nozzle outlet area 30, comprising a 180° turn. The underwater channel 52 adjacent the pump remains relatively narrow and widens near the nozzle outlet area 30 as can best be seen in FIG. 2. The water is forced upward through the opening of the nozzle outlet 30, and is extruded through the nozzle, creating a sheet flow of water at a substantially supercritical velocity on the inclined surface 20. The nozzle 30 is adjustable and can create a sheet wave between ½" to 10" in depth. The water is turned upward and over due to the curvature of the nozzle outlet area 30.

As can be seen in FIG. 2*a*, the nozzle outlet area 30 is substantially level or beneath the water level of the pool area 21. This allows riders to skim over the nozzle and to be propelled up the incline from the pool area. The flow of water is powerful enough, however, that the flow is not affected by the spillage of water from the pool over the nozzle area.

FIG. 2*a* also shows the riding surface to be substantially horizontal 46 and then extending upward to the butterfly return area 32 at the elevated end of the riding surface. It should be noted that the riding surface can be slightly inclined beginning from the nozzle outlet area 30, rather than immediately horizontal.

Figure 9:
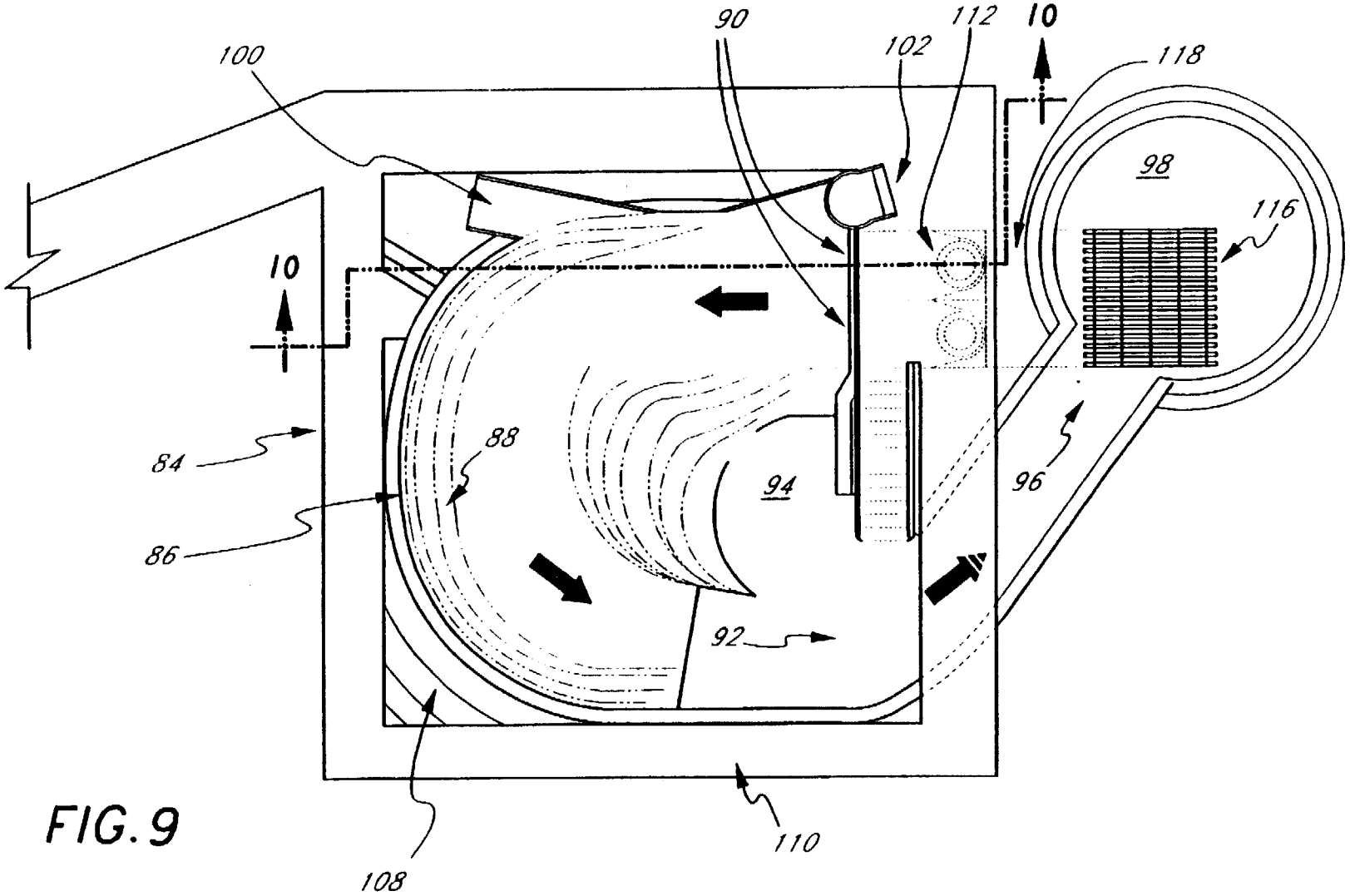
FIG. 9 is a plan view of an embodiment with a nozzle/injection mechanism positioned at an elevation above the pool.

In an alternate embodiment of the present invention, as shown in FIG. 9, a single riding surface 84 is provided having a single embanked turn 86. Rather than having dual riding surfaces in the shape of a butterfly return, this embodiment has a single curved shoulder 88 upon which flows the supercritical sheet flow of water. Water is injected onto the ride surface from the nozzle/injection mechanism 90 and travels around the curved shoulder 88 and down into the splash-down area 92 of the pool 94.

The pool area can also comprise various configurations, including a river chute 96 formed between opposite ends of the pool. In this embodiment, the water flows around the curved shoulder 88 and enters the pool 94 and flows through the river chute 96 to the exit area 98 of the pool. The pool at this juncture can also be connected to other bodies of water including a lazy river pool (not shown).

The rider also enters the ride surface from an entry slide 100 positioned adjacent one side of the ride surface 84. The entry slide 100 of this embodiment is similar to the entry slide of the preferred embodiment, with the exception that the slide permits the rider to enter tangentially with respect to the ride surface. The rider slides down the entry slide 100 and onto the ride surface 84 against the direction of flow, wherein the rider can perform water-skimming maneuvers thereon.

An alternate slide entry 102 can also be provided. From this alternate slide entry, a rider can slide onto the ride surface in the same direction as the water flow. This permits the rider to be carried by the supercritical flow around the curved shoulder 88 and down into the pool 94 for an exciting ride.

Figure 10:
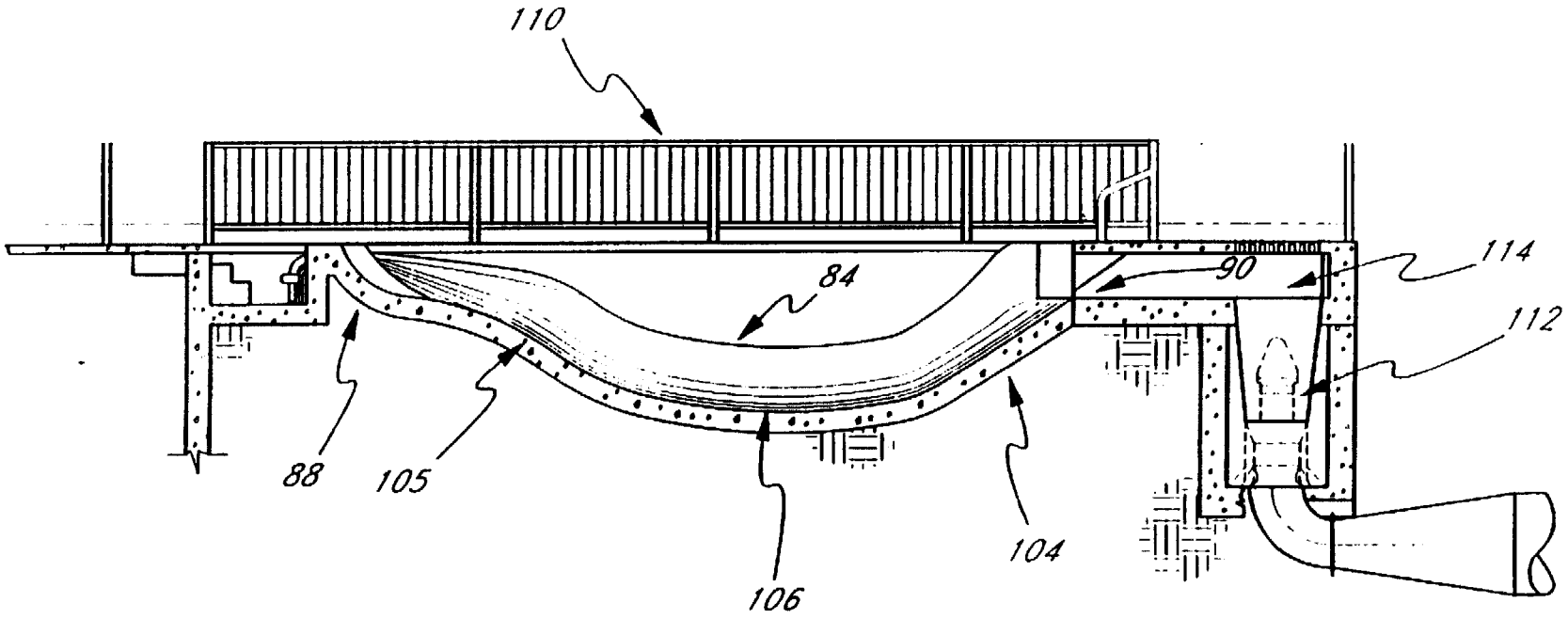
FIG. 10 is a cross-section of FIG. 9 and highlights the above pool elevation of the injection mechanism as well as the decline followed by incline profile of the ride surface.

One other feature of this embodiment is that the injection of the water onto the ride surface 84 is initially downward on a declined surface 104 relative to the water flow on the pump side or upstream side of the ride surface. As can be seen in FIG. 10, which is a cross-section of the ride surface parallel to the flow, the water is injected at a downward angle onto the ride surface 84, and flows relatively downward and then upward onto an incline 105 at the downstream side of the ride surface and around the curved shoulder 88. Though this declined surface 104 is provided in the alternate embodiment, a declined surface can also be provided in the preferred embodiment relatively near the center of the pool.

The main advantage of the declined surface 104 near the pump side or upstream side of the ride surface 84 is to permit an alternate embodiment design that is safe, compact and flexible in ability to locate the height of the nozzle 90 aperture. Site conditions may preclude a below water level nozzle location (as previously described in the preferred embodiment). Above water level nozzles 90 are possible, so long as specific design criteria are observed. In particular, the nozzle 90 must be positioned to avoid injurious collision with a rider that slides down the face of the incline 105. One solution is to place an extended horizontal ride surface 46 between the nozzle aperture and the incline as discussed in the preferred embodiment. Flow friction against a counter-flow moving rider will eventually provide sufficient momentum transfer to stop the rider and push him or her back up the incline. The disadvantage to the extended horizontal ride surface 46 is increased size and cost of construction.

The declined surface 104 on the pump side of the ride surface prevents the rider from sliding into the elevated nozzle 90 outlet area by taking advantage of the deceleration due to gravity as a rider rides up the decline, thereby increasing safety. This decline surface 104 also permits the ride surface to be relatively compact and comprises less space, insofar as the extended horizontal section can be avoided without sacrificing safety. This configuration also permits the rider to perform oscillating maneuvers on the ride surface in a direction parallel to the flow.

Preferably, the decline surface 104 on the pump side of the ride surface is at an decline of between 12°–25°, with 18° being the preferred decline. The degree of incline of the inclined riding surface 105 can also be made to equal the degree of decline of the declined surface 104.

The ride surface in this embodiment is approximately 40 feet in length from the nozzle 90 outlet area to the edge of the curved shoulder 88, although the length can be altered depending upon the necessities of site topography. The elevation of the nozzle 90 outlet can also be equal to the elevation of the upper section of the curved shoulder 88, although the nozzle 90 outlet elevation can be slightly lower. The nozzle 90 can be as low as one-half the elevation between the bottom 106 of the riding surface 84 to the top of the incline surface 105 and still provide the benefits discussed herein.

The ride surface has an embanked turn 86 and is also tilted to one side to permit the excess flow of water to drain off to the side of the ride surface 84 into the pool 94. Preferably, the lower elevation side of the tilt (near the pool) is positioned on the side of the ride surface adjacent the inside of the embanked turn (the transition slide area).

In this alternate embodiment, a viewing gallery 108 or cantilevered walkway 110 is provided around the perimeter of the ride surface to enable participants and viewers to view the entire riding area. The walkway 110 also serves as a queuing area for participants waiting to enter the ride. The walkway 110 is generally at an elevation above the ride surface, and is positioned above the nozzle 90 outlet area and the pumps 112.

In this embodiment, a vertically-oriented pump 112 mechanism can be provided which draws water from a lower elevation and pumps the water upward, wherein water is extruded from a narrow nozzle 90 onto the riding surface 84. As shown in FIG. 10, water is drawn in from the bottom of the pump 112, and is pumped into an upper nozzle area 114, which is configured to have a narrow converging opening through which the water is extruded at high pressure. A grate 116 is provided between the exit area 98 of the pool and the sump area 118 to prevent unwanted objects and persons from entering the pump area.

Figure 3:
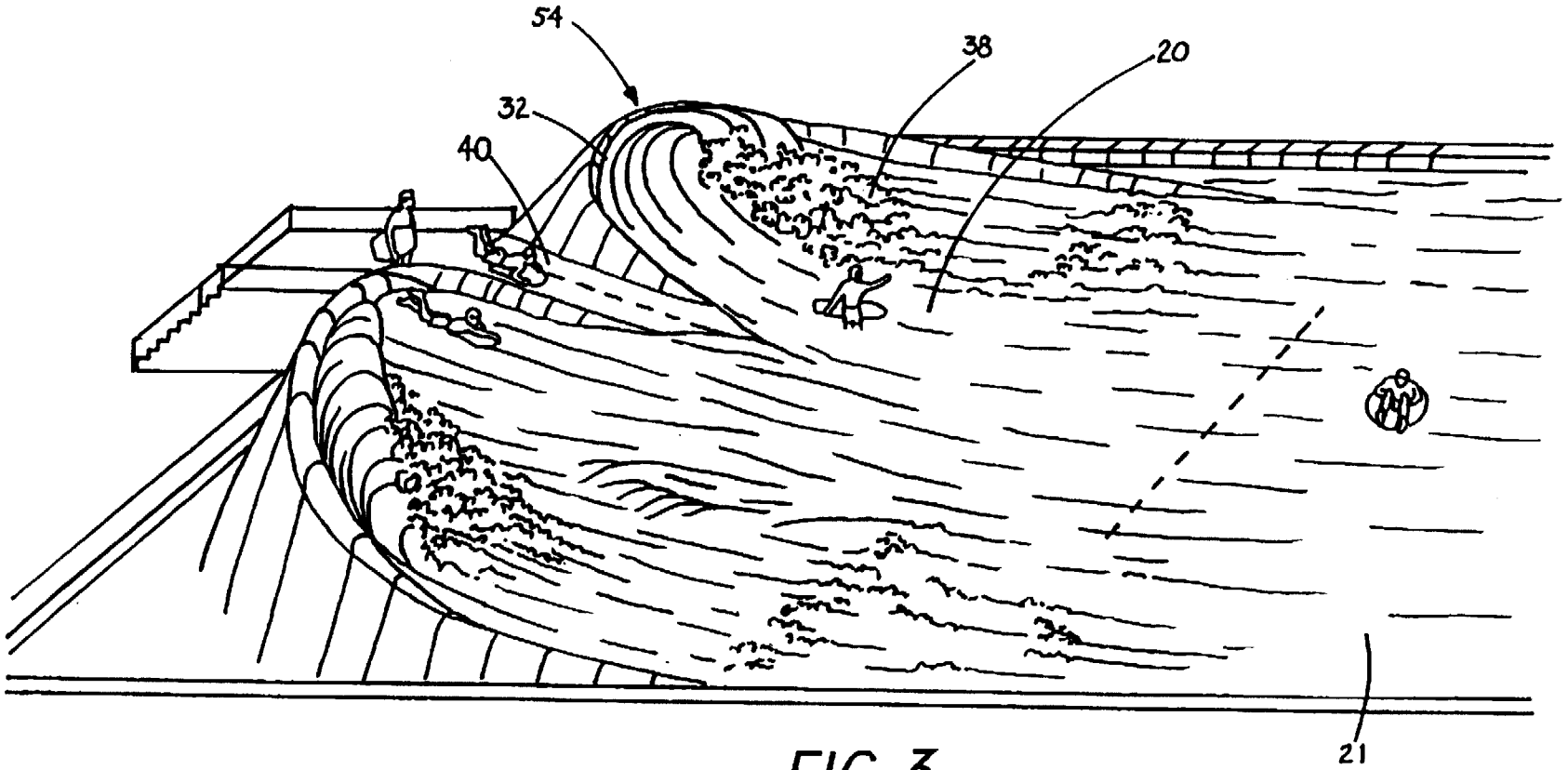
FIG. 3 is an illustration of the present invention showing the butterfly return configuration of the preferred embodiment with a tunnel wave generating device installed at the outer turn edge of the return.

In another embodiment of the present invention, as shown in FIG. 3, a tunnel wave generating device 54 can be installed at the top of the embanked turn or butterfly return 32 configuration of the present invention. In this embodiment, the rider is propelled up the inclined surface 20 and is propelled upward toward a wave generating device 54 which is obliquely positioned such that the water flows across the face of the generating device and off to the side and down the declined portion 38 of the ride surface. In this embodiment, the velocity of the water must be increased and must be sufficient to maintain a supercritical flow which extends up and across the tunnel wave generating device 54 at the top of the incline 20. Moreover, due to the increase in velocity of the water flow, the entry slide 40 must be positioned at an elevation slightly higher than the inclined riding surface 20, and can have a greater inclination to prevent water from flowing up the entry slide. It should be noted that the tunnel wave generating device can be located on one side of the butterfly return, so that the other side may have a separate configuration comprising a different embodiment.

Figure 4:
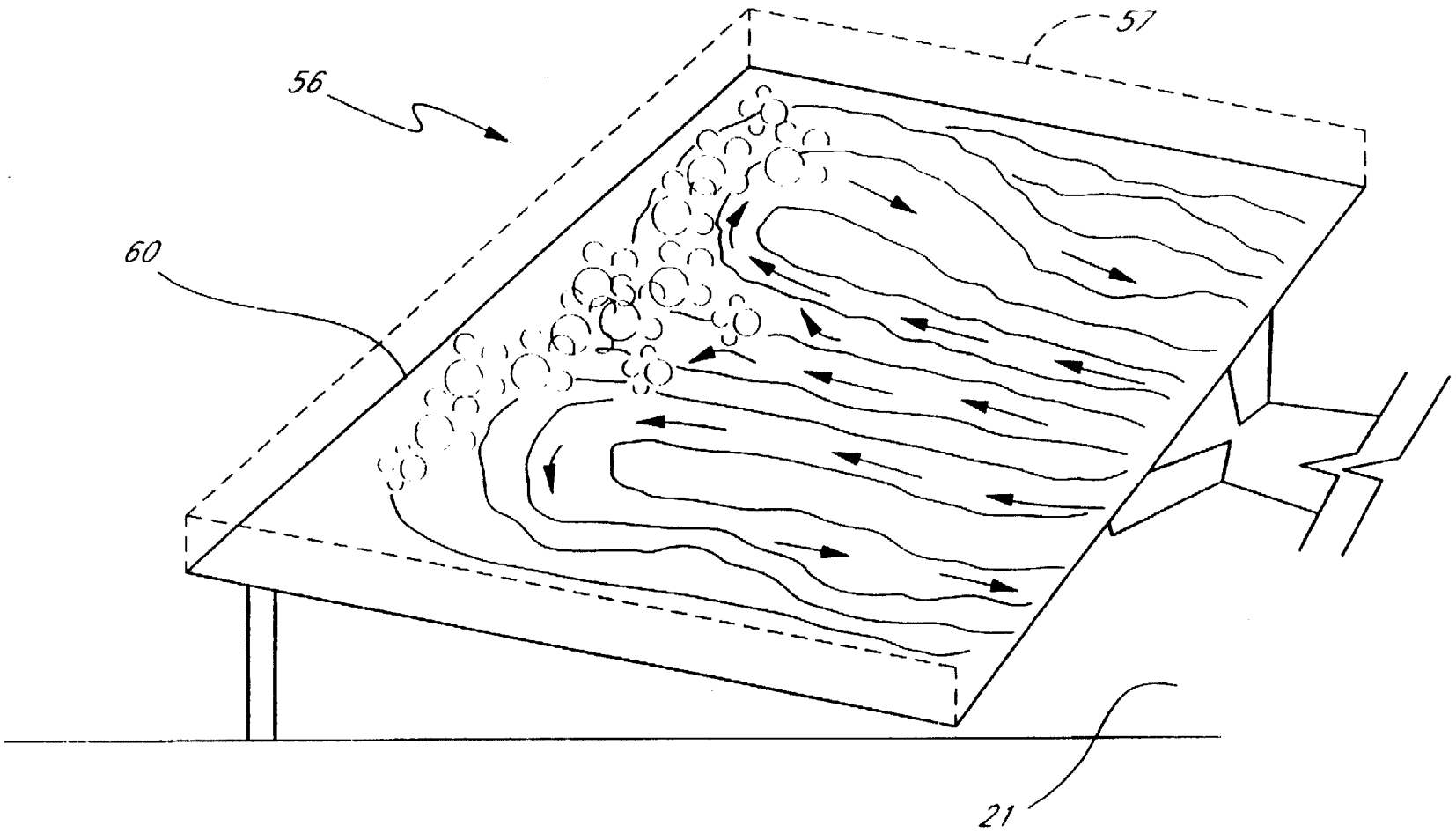
FIG. 4 is an illustration of the present invention showing the planar surface embodiment.

FIG. 4 shows another embodiment of the present invention in which the riding surface 56 is inclined but also substantially planar. In this embodiment, the water is injected onto the inclined surface 56 at a supercritical velocity which, due to the forces of gravity and frictional drag, is reduced to a subcritical flow along the top and sides of the water flow. Due to gravity and friction, the supercritical flow thickens at the top of the flow and creates a head with a hydraulic jump. Moreover, as water tends to seek a low pressure area, the flow of water automatically circles around and back down the sides of the inclined surface 56. The shape of the water flow in this embodiment is a butterfly configuration, but is also similar to a two-dimensional water fountain projected sideways. The water in the center of the inclined surface 56 is supercritical, while the water on the top is subcritical.

As shown in FIG. 4, this inclined surface can have sidewalls 57 along the outer edges of the inclined surface 56 to contain the water. The sidewalls 57, however, must be far enough away from the flow so that they do not affect the supercritical flow of the water on the surface. The inclined surface 56 may also be left containerless provided that adequate safety measures are taken to ensure that riders do not fall off the edge of the inclined surface and cause injury. Moreover, the top edge 60 of the inclined surface does not necessarily require a containment wall, and the water flowing upward on the inclined surface may be allowed to flow off the top of the inclined surface, again provided that adequate safety measures, i.e., a flow fence or an extension of the pool area underneath the inclined surface, are provided to prevent injury to the rider.

In this embodiment, an entry slide (not shown) may be placed at the top of the incline to allow entry onto the inclined surface 56 much like the previous embodiment discussed above. This embodiment also has the unique at-or-below surface-level nozzle outlet 30 to allow riders to enter the ride surface directly from a pool area 21.

Figure 5:
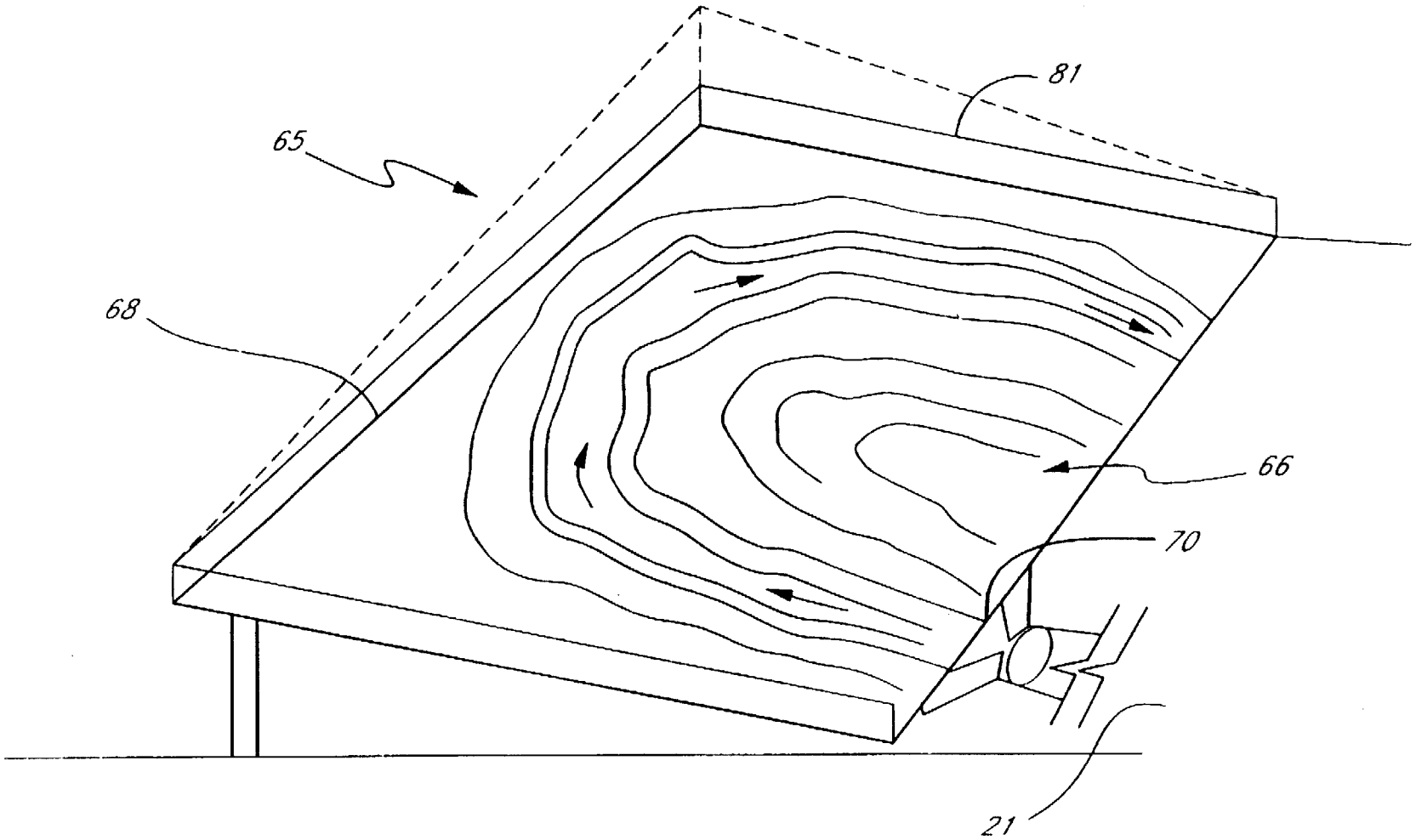
FIG. 5 is an illustration of the present invention showing the tilted ride surface embodiment.

FIG. 5 shows another embodiment of the present invention, comprising a ride surface 65 that is level along the bottom surface 66 adjacent the pool area, but which is tilted to one side at the top 68 of the incline. Moreover, the nozzle outlet area 70 on this embodiment is off center and located on one side of the inclined surface 65 such that the water flows upward and around in a single half butterfly return configuration to the other side. The ride surface 65 is slightly warped or twisted such that the water flowing up the incline will, due to gravity, flow from a higher to a lower pressure area and form a flow of water in a semi-circular fashion. The water in this embodiment may remain supercritical along the entire circular movement of the water flow.

In this embodiment, the water flows upward, around and downward on the riding surface, primarily due to the force of gravity, which maintains the water on the ride surface in an arc pattern. This embodiment can also have sidewalls 81 to maintain the riders on the ride surface 65, wherein the sidewalls are situated away from the flow so that they do not affect the supercritical flow of the water.

The entry slide (not shown) in this embodiment may be located at the top of the incline 65 on the nozzle outlet 70 side of the surface. This embodiment also advantageously has an at-or-below surface-level nozzle area 70 to allow riders to enter the water ride directly from the pool area 21.

Figure 6:
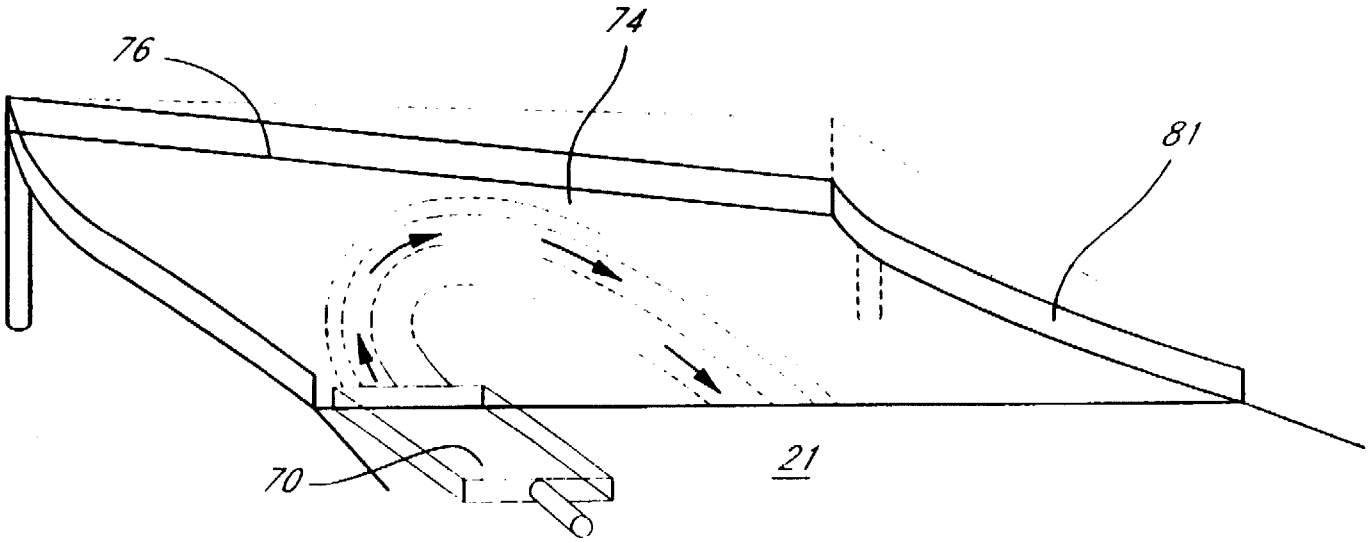
FIG. 6 is a perspective drawing of the present invention showing the tilted ride surface.

FIG. 6 shows a perspective view of a tilted ride surface 74 of this embodiment, showing that at the top 76 of the inclined surface, the elevation on the nozzle 70 side is higher than on the opposite side. The ride surface is also slightly concave in shape which assists in directing the water in a circular fashion, as can best be seen in FIG. 7.

Figure 7:
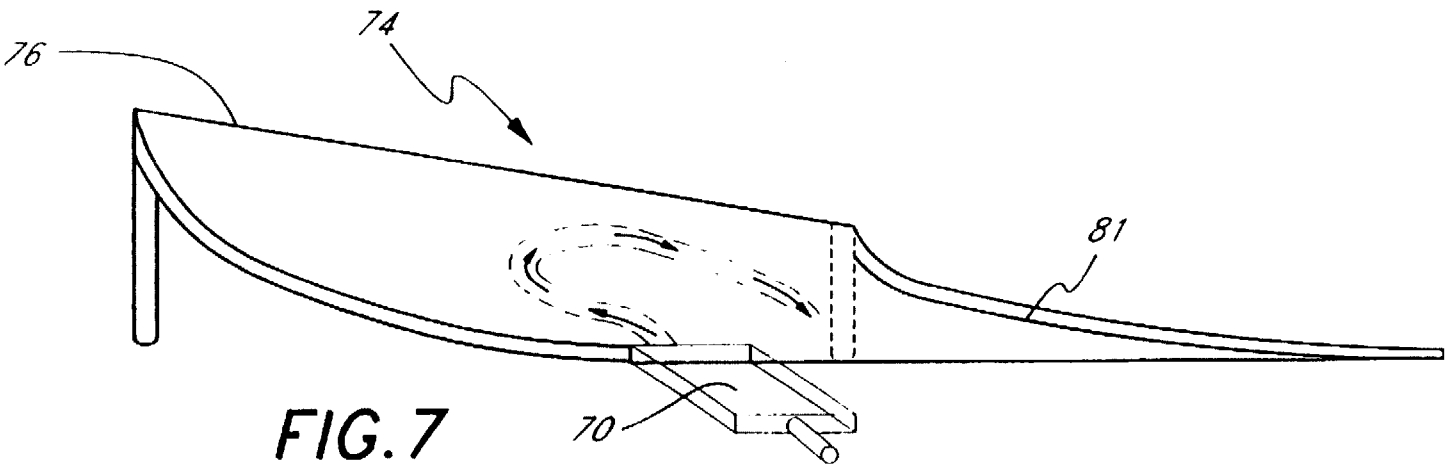
FIG. 7 is a perspective view of the warped ride surface.

FIG. 7 shows the tilted ride surface 74 and off-center nozzle 70 having a concave riding surface, which has a curvature tending to direct the flow of water upward, across and downward. The water being injected from the outlet nozzle 70 at an angle is directed onto the concave riding surface 74, and, by virtue of the incline, the water is directed back downward toward the pool area 21.

Figure 8:
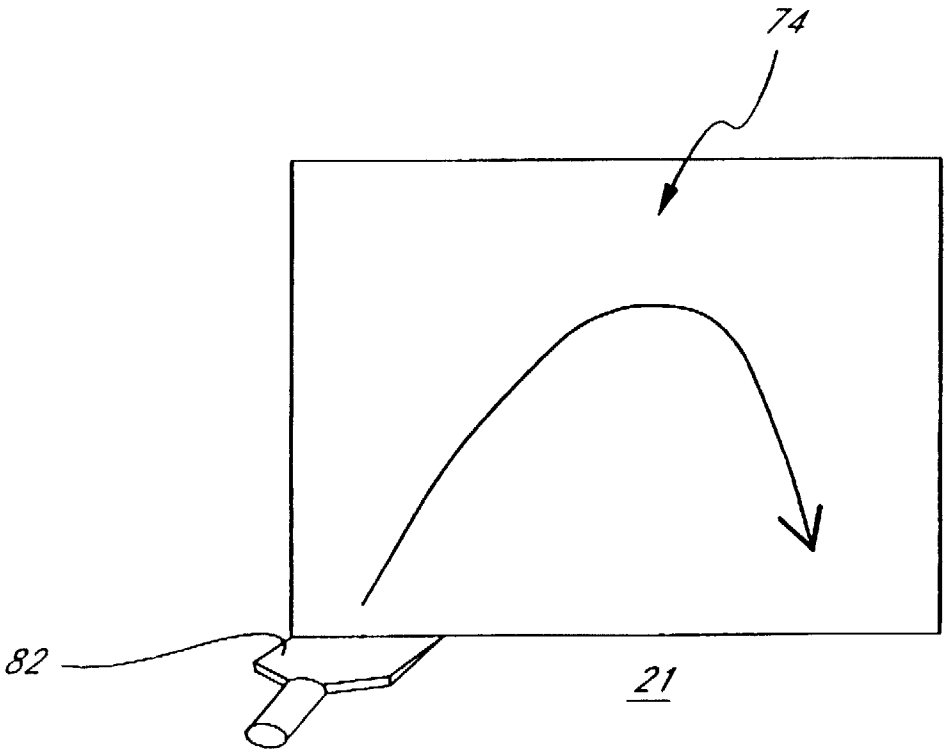
FIG. 8 is a plan view showing the tilted ride surface embodiment with angled nozzle.

FIG. 8 is a plan view of the tilted ride surface 74 showing the direction of flow of an angled nozzle 82 outlet. In this embodiment, the water flows at an angle from the nozzle outlet 82 and onto the inclined surface 74 and, due to the forces of gravity, is turned back down and around into the pool area 21.

What is claimed is:

1. A water ride for water parks and amusement parks suitable for use in or near an adjacent body of water, comprising:

a ride surface adapted to be installed in or near said adjacent body of water;

at least one water jet sized and configured so as to be placed in fluid communication with said adjacent body of water for providing a continuous sheet flow of super-critical water on said ride surface, said sheet flow of water permitting a rider to perform water skimming maneuvers thereon; and said ride surface comprising, relative to said sheet flow of water, a declined upstream portion and an inclined downstream portion, said ride surface forming an embanked turn whereby water from said adjacent body of water is propelled onto said ride surface and then transitions around said embanked mm and is returned downward reentering said adjacent body of water.

2. The water ride of claim 1, wherein a portion of said ride surface rises above the surface elevation of the water in said adjacent body of water, wherein said flow of water is propelled upward onto said ride surface.

3. The water ride of claim 1, wherein said embanked turn is tilted and angled such that said super critical sheet flow of water is adapted to transition around and return back into said adjacent body of water.

4. The water ride of claim 1, wherein said water jet is positioned relative to said ride surface so as to be at or below the surface elevation of the water in said adjacent body of water wherein a rider may pass over said water jet and enter onto said ride surface directly from said adjacent body of water.

5. The water ride of claim 1, wherein said water jet is positioned relative to said ride surface so as to be above the surface elevation of the water in said body of water wherein said flow initially travels downward onto said declined portion before traveling up said inclined portion of said ride surface.

6. The water ride of claim 1, wherein said ride surface comprises two substantially similar but reversely oriented ride surfaces, each of said ride surfaces having an embanked turn so as to enable said flow to transition around and return downwardly reentering said adjacent body of water.

7. The water ride of claim 1, wherein said ride surface has an upper edge positioned so as to rise above the surface elevation of the water in said adjacent body of water so that said sheet flow of water moves upward and around the inside of said upper edge, wherein said flow of water is contained within or by said upper edge, and is returned back into said adjacent body of water.

8. A self-contained water ride for water parks and amusement parks comprising:

a body of water;

a riding surface in operative association with said body of water, said riding surface having an inclined portion rising above the surface elevation of the water in said body of water and having an embanked turn thereon; and at least one water jet for providing a substantially continuous flow of water from said body of water over said inclined portion of said riding surface in a first direction, wherein said rider may perform water skimming maneuvers thereon, said flow of water transitioning around said embanked turn such that said flow travels in a second direction eventually reentering said body of water directly from said ride surface without requiring a separate return conduit.

9. The water ride of claim 8 wherein said inclined portion of said riding surface comprises, relative to said flow of water, a declined upstream portion and an inclined downstream portion.

10. The water ride of claim 9 wherein said upstream and downstream portions of said riding surface have an angle of incline or decline along said first direction of between about 12° and 25°.

11. The water ride of claim 9 wherein said upstream and downstream portions of said riding surface have an angle of incline or decline along said first direction of about 18°.

12. The water ride of claim 9 further comprising an entry slide disposed adjacent said upstream portion of said riding surface for enabling a rider to enter said inclined portion of said riding surface tangential to said flow thereon.

13. The water ride of claim 12 wherein said entry slide has a downward sloping slide surface terminating in said first direction of said flow.

14. The water ride of claim 9 further comprising an entry slide disposed adjacent said downstream portion of said riding surface for enabling a rider to enter said inclined portion of said riding surface opposite said flow thereon.

15. The water ride of claim 8 wherein said inclined portion of said ride surface is tilted generally downward along said embanked turn.

16. The water ride of claim 8 further comprising a cantilevered walkway disposed along a portion of the periphery of said ride surface for facilitating viewing of said riders on said ride surface.

17. A water ride for amusement parks and waterparks comprising:

a ride surface adapted to be installed in or near an adjacent pool of water, said ride surface adapted to support a non-separated flow of super-critical water thereon of substantially uniform thickness upon which water skimming maneuvers may be performed;

said ride surface comprising a substantially stable riding area comprising, relative to said flow of water, a declined upstream portion and an inclined downstream portion, wherein a rider may perform water skimming maneuvers over a sustained period of time; and said ride surface comprising a substantially unstable exit area comprising an embanked turn tilted and angled downward such that said super-critical flow of water transitions around and returns said water and said rider to said adjacent pool of water.

18. The water ride of claim 17 wherein said upstream and downstream portions of said ride surface have an angle of incline or decline of between about 12° and 25° tangential to said flow of water thereon.

19. The water ride of claim 17 wherein said upstream and downstream portions of said ride surface have an angle of incline or decline of about 18° tangential to said flow of water thereon.

20. The water ride of claim 17 further comprising an entry slide disposed adjacent said upstream portion of said ride surface for allowing a rider to enter said stable riding area in a direction tangential to said flow thereon.

21. The water ride of claim 20 wherein said entry slide has a downward sloping slide surface terminating in the direction of said flow on said upstream portion of said ride surface.

22. The water ride of claim 17 further comprising an entry slide disposed adjacent said downstream portion of said ride surface for allowing a rider to enter said stable riding area in a direction opposite said flow thereon.

* * * * *

UNITED STATES PATENT AND TRADEMARK OFFICE

CERTIFICATE OF CORRECTION

PATENT NO. : 5,738,590

DATED : April 14, 1998

INVENTOR(S) : Lochtefeld

It is certified that error appears in the above-identified patent and that said Letters Patent is hereby corrected as shown below:

Column 13, line 56, replace "a declined" with --declined--.

Column 13, line 60, replace "embanked mm and is" with --embanked turn and is--.

Signed and Sealed this

Tenth Day of November 1998

Bruce Lehman

*Attest:*

BRUCE LEHMAN

*Attesting Officer*

*Commissioner of Patents and Trademarks*